US011008025B2

(12) United States Patent
Forbes

(10) Patent No.: US 11,008,025 B2
(45) **Date of Patent: *May 18, 2021**

(54) RAILROAD GONDOLA CAR STRUCTURE

(71) Applicant: National Steel Car Limited, Hamilton (CA)

(72) Inventor: James W. Forbes, Campbellville (CA)

(73) Assignee: NATIONAL STEEL CAR LIMITED, Hamilton (CA)

( * ) Notice: Subject to any disclaimer, the term of this patent is extended or adjusted under 35 U.S.C. 154(b) by 218 days.

This patent is subject to a terminal disclaimer.

(21) Appl. No.: 16/251,350

(22) Filed: Jan. 18, 2019

(65) Prior Publication Data

US 2019/0152496 A1 May 23, 2019

Related U.S. Application Data

(63) Continuation of application No. 14/850,260, filed on Sep. 10, 2015, now abandoned, which is a (Continued)

(51) Int. Cl.
*B61D 17/00* (2006.01)
*B61F 1/12* (2006.01)
(Continued)

(52) U.S. Cl.
CPC ..... *B61D 17/00* (2013.01); *B61D 3/00* (2013.01); *B61D 9/00* (2013.01); *B61D 17/08* (2013.01); *B61F 1/12* (2013.01)

(58) Field of Classification Search
CPC ..... B61D 17/00; B61D 17/08; B61D 3/00; B61D 9/00
(Continued)

(56) References Cited

U.S. PATENT DOCUMENTS 725,213 A 4/1903 Buhoup
831,654 A 9/1906 Dodds
(Continued)

OTHER PUBLICATIONS

Blodgett, Omer. W., "Rigid-Frame Knees (Elastic Design)" in Design of Welded Structures, James F Lincoln Arc Welding Foundation., Jun. 1966, pp. 5.11-1 to 5.11-20.
(Continued)

*Primary Examiner* — Jason C Smith
(74) *Attorney, Agent, or Firm* — Whiteford, Taylor & Preston, LLP; Barry E. Bretschneider

(57) ABSTRACT

A gondola car has a body for lading carried on an underframe. The underframe includes a center sill and cross-bearers. The car has deep side beams having top chords, side sills, and side sheets. The lower portion of the car includes tubs that seat between the cross-bearers. The car may have an internal volume of more than 8000 cu. ft. The car may have rotary dump claw sockets. The car has opposed internal and external stiffeners aligned at the longitudinal stations of the cross-bearers. The internal stiffeners may be triangular cantilevers extending upwardly inside the side sheets. The side sheet lies intermediate the stiffeners and their flanges. The top chords may be wider in cross-section than the side sills. The side sills may define torque tubes that co-operate with the sidewall stiffeners and the top chords to resist lateral deflection. The car may include a false deck, or dog-house at one end to accommodate the brake reservoir and brake valve, such that the car is longitudinally asymmetric.

20 Claims, 11 Drawing Sheets

Related U.S. Application Data continuation of application No. 12/177,106, filed on Jul. 21, 2008, now Pat. No. 9,156,478.

(51) Int. Cl.
*B61D 17/08* (2006.01)
*B61D 3/00* (2006.01)
*B61D 9/00* (2006.01)

(58) Field of Classification Search
USPC ..... 104/406.1, 406.2, 396, 404, 411, 413, 104/416, 417, 418, 419
See application file for complete search history.

(56) References Cited

U.S. PATENT DOCUMENTS 1,703,756 A * 2/1929 Wine ..... B61D 7/00 105/249
1,768,728 A 7/1930 Zimmer
1,803,449 A * 5/1931 Wine ..... B61D 9/06 105/230
1,804,769 A 5/1931 Hart et al.
1,834,264 A 12/1931 Wine
1,962,717 A 6/1934 Kiesel, Jr.
1,981,714 A 11/1934 Yost
2,012,999 A * 9/1935 Lamont ..... B61D 9/06 105/406.1
2,072,996 A 3/1937 Wine
2,092,457 A * 9/1937 Kiesel, Jr. ..... B61D 11/00 105/247
2,104,359 A * 1/1938 Wine ..... B61D 7/02 105/247
2,146,221 A 2/1939 Meyer et al.
2,167,362 A 7/1939 Hindahl
3,240,168 A * 3/1966 Franklin ..... B61D 9/06 105/406.1
3,421,453 A * 1/1969 Williams ..... B61D 17/08 105/406.1
3,713,400 A * 1/1973 Teoli ..... B61D 9/00 105/406.1
3,844,229 A * 10/1974 Martin ..... B61F 1/10 105/248
3,866,545 A * 2/1975 Heap ..... B61D 9/06 105/406.1
3,964,399 A 6/1976 Miller et al.
RE30,388 E 9/1980 Mundinger et al.
4,236,459 A * 12/1980 Teoli ..... B61D 7/02 105/244
4,252,067 A 2/1981 Stark
4,254,714 A * 3/1981 Heap ..... B61D 7/00 105/364
4,262,601 A 4/1981 Miller
4,280,778 A 7/1981 Knippel
4,301,742 A 11/1981 Patil et al.
4,331,083 A * 5/1982 Landregan ..... B61D 9/06 105/247
4,359,001 A 11/1982 Brodeur et al.
4,417,526 A 11/1983 Marulic et al.
4,497,258 A * 2/1985 Ruhmann ..... B61D 7/02 105/248
4,498,400 A * 2/1985 Vorwerk ..... B61D 17/048 105/248
4,633,787 A 1/1987 Przybylinski et al.
4,637,320 A * 1/1987 Paton ..... B61D 9/06 105/3
4,646,653 A * 3/1987 Balbi ..... B61D 7/00 105/406.1
4,690,071 A * 9/1987 Billingsley ..... B61D 7/00 105/247
4,690,072 A * 9/1987 Wille ..... B61D 17/043 105/199.3
4,738,203 A * 4/1988 Gielow ..... B61D 17/02 105/1.1
4,771,705 A 9/1988 Przybylinski et al.
4,840,127 A * 6/1989 Tomaka ..... B61D 7/00 105/396
4,898,101 A * 2/1990 Harter ..... B61D 7/02 105/247
4,930,427 A 6/1990 Ritter et al.
5,070,793 A * 12/1991 Kurtz ..... B61D 17/08 105/406.1
5,335,603 A * 8/1994 Wirick ..... B61D 7/02 105/406.1
5,373,792 A * 12/1994 Pileggi ..... B61D 17/04 105/406.1
5,727,475 A * 3/1998 Kurtz ..... B61D 17/08 105/404
6,138,581 A * 10/2000 Smith ..... B61D 17/04 105/406.1
6,164,210 A * 12/2000 Coslovi ..... B61D 7/00 105/396
6,601,522 B2 * 8/2003 Roxby ..... B61D 17/08 105/355
6,865,992 B1 * 3/2005 Fetterman ..... B61D 7/02 105/238.1
6,877,440 B1 * 4/2005 Kilian ..... B60P 1/286 105/406.1
6,978,720 B2 12/2005 Johnson
7,434,519 B2 10/2008 Forbes et al.
7,461,600 B2 12/2008 Forbes et al.
7,559,284 B2 7/2009 Forbes et al.
2007/0101895 A1 * 5/2007 Forbes ..... B61D 17/00 105/406.1
2007/0101896 A1 * 5/2007 Forbes ..... B61D 17/00 105/406.1
2007/0277696 A1 * 12/2007 Forbes ..... B61D 9/00 105/406.1
2008/0127854 A1 * 6/2008 Forbes ..... B61D 7/00 105/247
2010/0006000 A1 1/2010 Forbes et al.
2010/0011987 A1 * 1/2010 Forbes ..... B61D 17/08 105/406.1
2010/0101447 A1 * 4/2010 Nutt ..... B61D 7/00 105/406.1

OTHER PUBLICATIONS

"The Car and Locomotive Cyclopedia of American Practices", 6th ed., ("The 1997 Cyclopedia") 1997, Simmons-Boardman, Omaha, Section 1, "Open Top Hoppers" pp. 46-69.
"The Car and Locomotive Cyclopedia of American Practices", 6th ed., ("The 1997 Cyclopedia") 1997, Simmons-Boardman, Omaha, Section 1, "Gondolas" pp. 74-93.

* cited by examiner

RAILROAD GONDOLA CAR STRUCTURE

CROSS REFERENCE TO RELATED APPLICATION

This application is a continuation of U.S. patent application Ser. No. 14/850,260, filed Sep. 10, 2015, which was a continuation of U.S. patent application Ser. No. 12/177,106, filed Jul. 21, 2008 (U.S. Pat. No. 9,156,478, issued on Oct. 13, 2015), the entire contents of which are hereby incorporated by reference herein.

FIELD OF THE INVENTION

This invention relates to the field of railroad freight cars, and, in particular to rail road gondola cars.

BACKGROUND

It is often desirable for rail road cars to weigh out at the same time as they bulk out. For example, the maximum gross weight on rail of a "110 Ton" railroad freight car in North America is 286,000 lbs. If the car carries less than the maximum allowed lading by weight, then an unnecessarily high proportion of the weight being hauled is the weight of the car itself—which is also backhauled empty. Therefore, it follows that most often when relatively low density lading is to be carried it is desirable to have a high volume. This reflects conventional understanding in the railroad industry. Municipal waste tends to provide an example of relatively low density lading. Wood chips may provide another example.

It may be desirable to increase the size of the car by making the car taller. However, a fully laden car must not have a center of gravity more than 98 inches above top of rail (TOR). Therefore, is may also be desirable to extend the lading carrying envelope downward, below the upper flange (or top cover plate) of the center sill, below the height of the center of the couplers, and even below the bottom flange (or bottom cover plate) of the center sill. For this purpose a designer might consider the "bathtub" feature, of which the classic example is the bathtub gondola car shown and described in U.S. Pat. No. 4,361,097 of Jones et al., issued Nov. 30, 1982. As the walls of the gondola increase in height, there may not only be a center of gravity concern, but also a concern that the sidewalls of the car may begin to lack adequate side-ways stiffness. This may be particularly so where the car is to be emptied in a rotary dumping apparatus and where the length of the car has also been increased, with the truck centers being spaced more than, and possibly quite substantially more than, 46'-3" apart. Finally, it may be desired partially to compress the lading in the car. That is, in one example, it may be desired partially to compact municipal waste in the car as it is loaded.

SUMMARY OF THE INVENTION

In an aspect there of the invention there is a gondola car. It has a center sill, cross-bearers extending laterally of the center sill, and a receptacle defining an accommodation for lading. The receptacle is mounted to the cross-bearers and including predominantly upstanding sidewalls. The sidewalls include side beams running parallel to the center sill, the side beams having a top chord, a side sill, and a side sheet extending between the top chord and the side sill. The side sill defines a torque tube mounted to resist lateral deflection of the top chord. Sidewall reinforcements extend predominantly upwardly from the side sills. The sidewall reinforcements being connected to respective ones of the cross-bearers at structural knees.

In a feature of that aspect of the invention, the gondola car is a bathtub gondola car. In a further feature the gondola car is an ice-cube tray gondola car. In still another feature at least a portion of the receptacle includes a lading accommodation region lying lower than the center sill. In another feature the receptacle has a width, the upstanding sidewalls have an height, and the height is greater than the width. In another feature, the receptacle has an inside length, and inside width, and an inside height measured upwardly of the center sill, wherein the length is at least five times as large as the width, and the height is at least as great as the width.

In another feature, the cross-bearers include a first cross-bearer having a pair of spaced apart webs, an upper flange and a lower flange. The reinforcements include a first reinforcement associated with the first cross bearer, the first reinforcement being connected to the first cross-bearer distant from the center sill. The first reinforcement has a pair of webs corresponding to the webs of the first cross-bearer. The reinforcement has a first flange spaced from the side sheet. The cross-bearer has an end cap mounted across the webs of the first cross-bearer. The end cap mates with the bottom flange and the top flange of the first cross-bearer. The first flange of the first reinforcement, and the side sheet, are mounted to transmit a moment couple to the upper and lower flanges of the first cross-bearer through the structural knee.

In another feature, the cross-bearers include a first cross-bearer having a pair of spaced apart webs, an upper flange and a lower flange. The reinforcements include a first reinforcement associated with the first cross bearer, the first reinforcement being connected to the first cross-bearer distant from the center sill. The first reinforcement has a pair of webs corresponding to the webs of the first cross-bearer. The first reinforcement has a first flange spaced laterally outboard from the side sheet. The first reinforcement has a second flange spaced laterally inboard from the first flange. The first cross-bearer has an end cap mounted across the webs of the first cross-bearer, the end cap having flange continuity with the first flange of the first reinforcement, the cap plate being mounted to transfer loads from the first flange of the first reinforcement into the webs of the first cross bearer. The first cross-bearer has a flange continuity member associated with the second flange of the first reinforcement, mounted between the top and bottom flanges thereof, the flange continuity member being mounted to transfer loads from the second flange of the first reinforcement to the webs of the first cross-bearer. The upper and lower flanges of the first cross-bearer are mounted to react loads transferred to the webs of the first cross-bearer from the first and second flanges of the first reinforcement.

In still yet another feature, the cross-bearers include a first cross-bearer having a pair of spaced apart webs, an upper flange and a lower flange. The reinforcements include a first reinforcement associated with the first cross bearer, the first reinforcement being connected to the first cross-bearer distant from the center sill. The first reinforcement has a pair of webs corresponding to the webs of the first cross-bearer. The first reinforcement has a first flange spaced laterally outboard from the side sheet. The first reinforcement has a second flange spaced laterally inboard from the first flange. The second flange has a length from a first end thereof mounted proximate to the first cross-bearer to a second end thereof distant from the cross-bearer; and over a majority of the length of the second flange, the side sheet is located laterally intermediate the first flange and the second flange of the first reinforcement.

In a further feature, the top chord has an enclosed cross-sectional area, a weight of section per unit of lineal measure, and a second moment of area in the lateral direction. The torque tube has an enclosed cross-sectional area, a weight of section per unit of lineal measure, and a second moment of area in the lateral direction. At least one of (a) the enclosed cross-sectional area of the top chord is greater than the enclosed cross-sectional area of the torque tube; (b) the weight of section of the top chord is greater than the weight of section of the torque tube; and (c) the second moment of area the top chord is greater than the second moment of area of the torque tube. In a further feature, all of (a), (b), and (c) are true.

In another aspect of the invention there is a rail road gondola car. The car has an underframe and a lading containment receptacle mounted thereto. The lading containment receptacle has a predominantly upstanding sidewall. The lading containment receptacle has an internal width, an internal length, and an internal height. The height is greater than the width. The receptacle is longitudinally asymmetric.

In another feature of that aspect of the invention, the receptacle has a feature of longitudinal asymmetry, the feature being a dog house formed at one end thereof. In another feature, the receptacle has a first end and a second end. At the first end the receptacle has a partial raised deck portion at one end thereof, the partial raised deck being unmatched at the second end. In another feature, the gondola car has a through center sill, the center sill has center plates mounted thereto for seating on corresponding center plate bowls of associated rail road car trucks. The center sill has a first end and a second end. The center sill has at least one of (a) brake reservoir, and (b) a brake valve, mounted at the first end thereof. The railroad car has an accommodation formed in the receptacle therefore. The accommodation protrudes longitudinally asymmetrically into the receptacle. In still another feature, the car has a volumetric capacity in excess of 8000 cu. ft.

In another aspect of the invention, there is a railroad gondola car having a receptacle for lading carried on trucks for rolling motion along railroad tracks. The receptacle includes upstanding sidewalls extending lengthwise along the car. The sidewalls include a top chord, a side sill, and predominantly upright side sheets extending therebetween. The sidewalls have predominantly upstanding side sheet reinforcements. The side sheet reinforcements include a first side sheet reinforcement having an outer flange and an inner flange, and a length. Over a majority of the length of the reinforcement the outer flange stands laterally outward of, and spaced from. the sheet. The inner flange stands laterally inwardly of the spaced sheet.

In a feature of that aspect of the invention, the rail road car includes rotary dumping fittings by which to grasp the receptacle for inversion. In another feature, the car has a through center sill, and receptacle has an inside width, and inside length, and an inside height measure upwardly of the center sill, the inside height being at least as great as the inside width; the car having a volumetric capacity greater than 8000 cu. ft. In a further feature, the first reinforcement includes an exterior member, the exterior member being a channel having first and second legs and a back defining the first flange, the legs having toes mounted to the side sheet; and the first reinforcement including an interior member, the interior member having webs and the second flange extending between the webs, the webs of the interior member having toes mounted to the side sheet substantially opposite the toes of the exterior member. In still another feature, the interior member tapers from a wide base adjacent the side sill to a narrower toe distant therefrom.

These and other aspects and features of the invention may be understood with reference to the description which follows, and with the aid of the illustrations of a number of examples.

BRIEF DESCRIPTION OF THE FIGURES

The description is accompanied by a set of illustrative Figures in which.

DETAILED DESCRIPTION

Figure 1A:
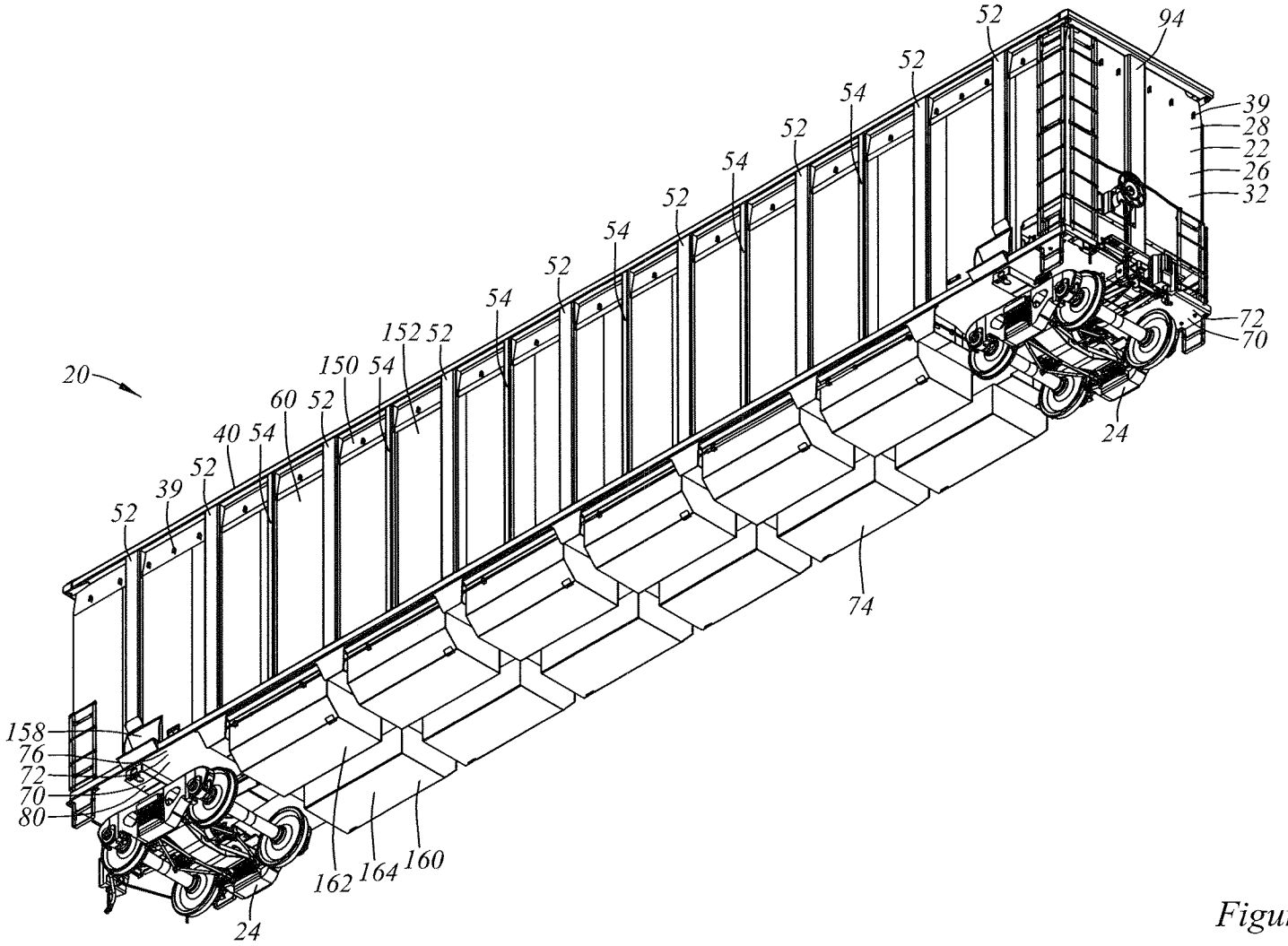
FIG. 1*a* is a general arrangement, isometric view of a railroad freight car such as a gondola car that may incorporate the various aspects of the present invention, the view being taken from below and to one diagonal corner.
Figure 1B:
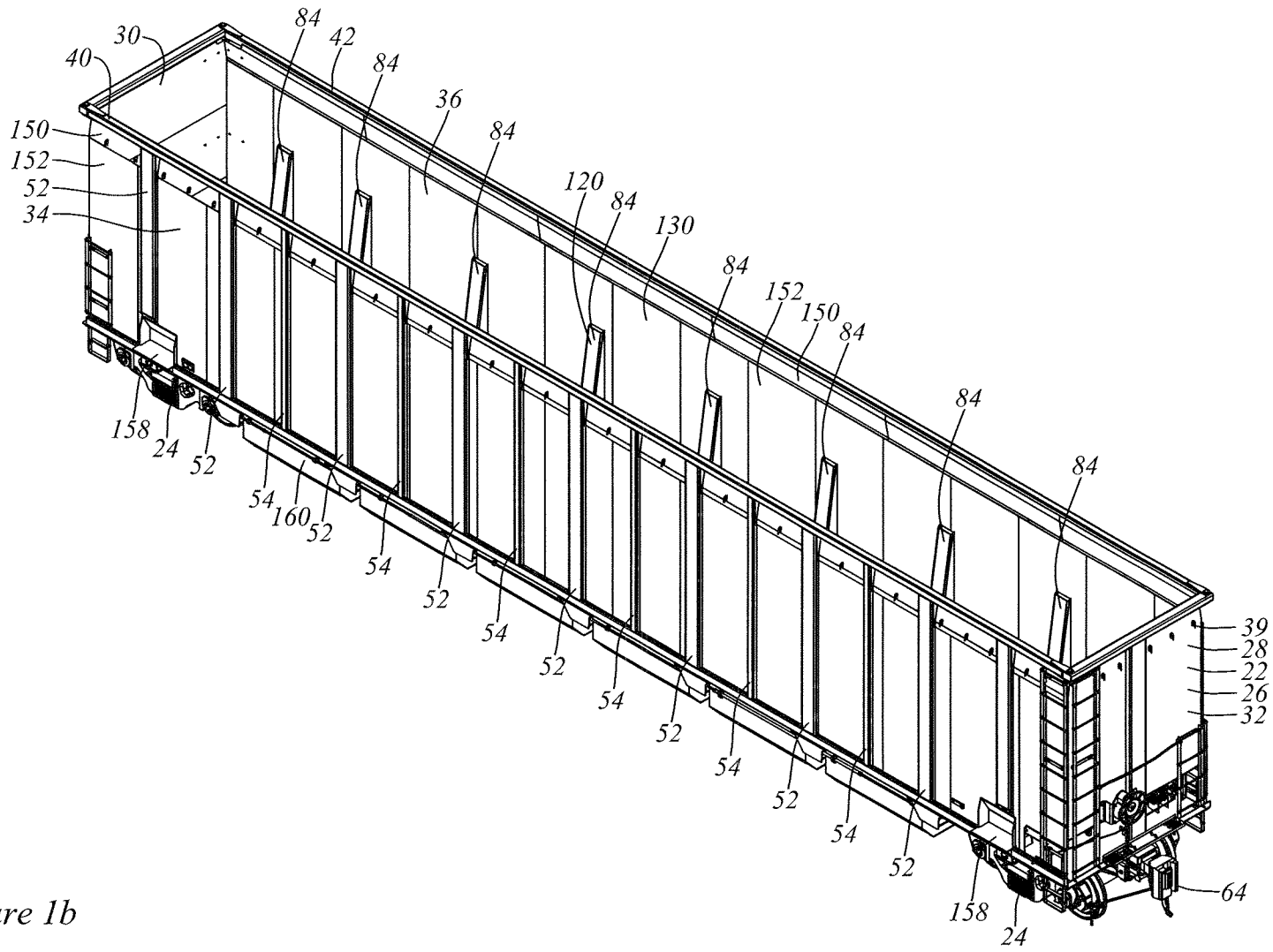
FIG. 1*b* is a general arrangement, isometric view of a the railroad freight car of FIG. 1*a* taken from above at that diagonal corner.
Figure 1D:
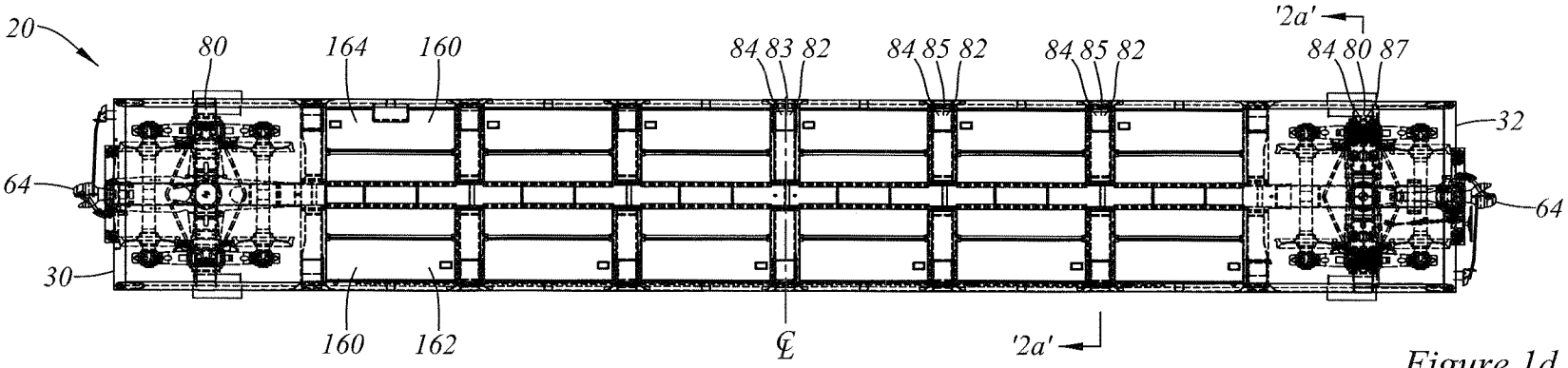
FIG. 1*d* is a top view of the railroad car of FIG. 1*a;*
Figure 1C:
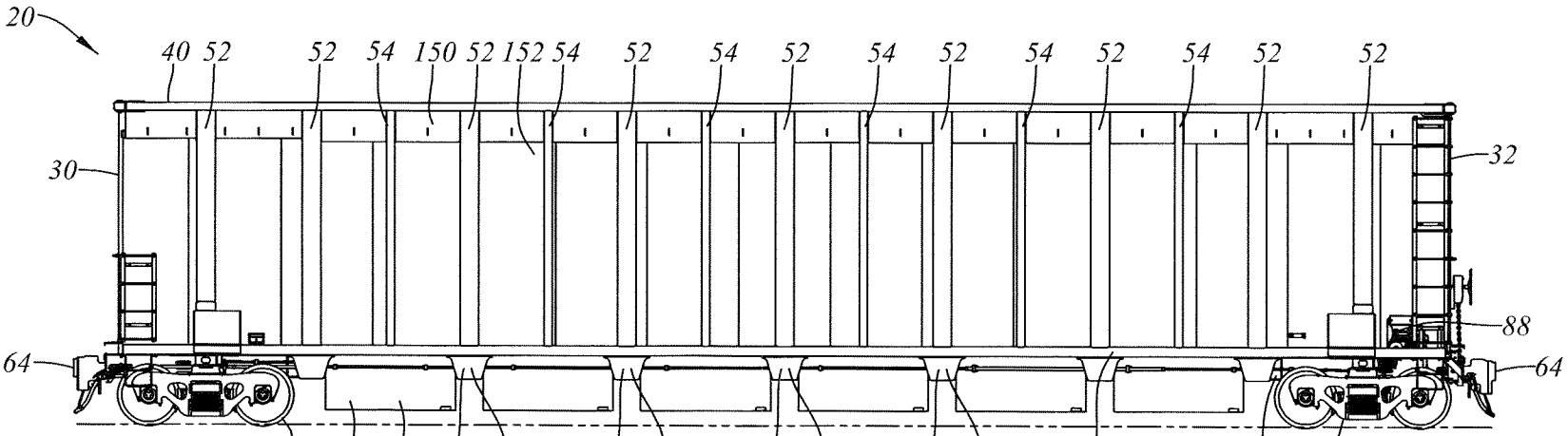
FIG. 1*c* is a side view of the railroad car of FIG. 1*a;*
Figure 1E:
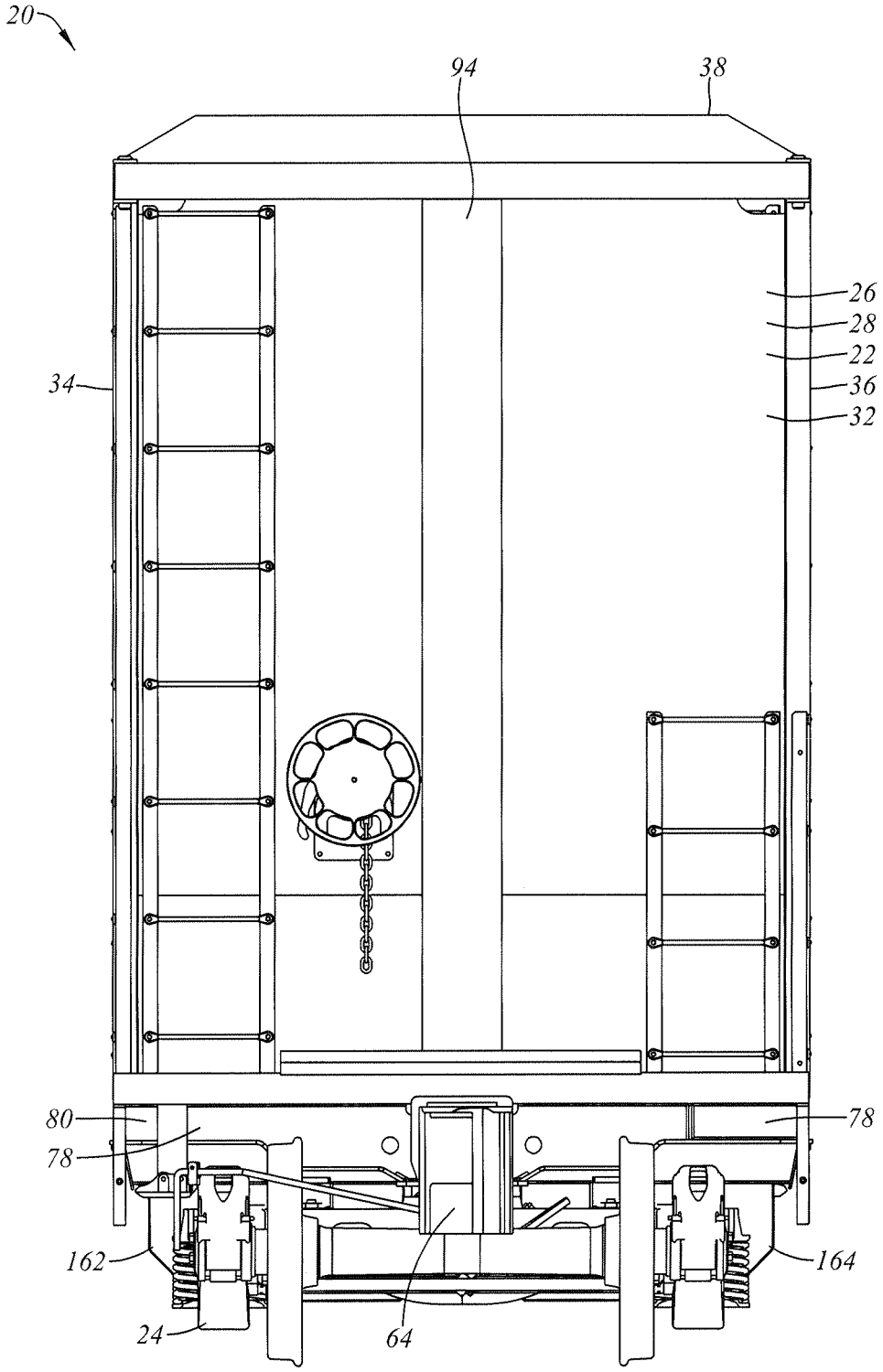
FIG. 1*e* is an end view of the railroad car of FIG. 1*a;*

The description that follows, and the embodiments described therein, are provided by way of illustration of an example, or examples, of particular embodiments of the principles, aspects or features of the present invention. These examples are provided for the purposes of explanation, and not of limitation, of those principles and of the invention. In the description, like parts are marked throughout the specification and the drawings with the same respective reference numerals. The drawings are generally to scale unless noted otherwise. The terminology used in this specification is thought to be consistent with the customary and ordinary meanings of those terms as they would be understood by a person of ordinary skill in the railroad industry in North America. Following from decision of the CAFC in *Phillips* v. *AWH Corp*., the Applicant expressly excludes all interpretations that are inconsistent with this specification, and, in particular, to confine the rule of broadest reasonable interpretation to interpretations that are consistent with actual usage in the railroad industry as understood by persons of ordinary skill in the art, or that are expressly supported by this specification, the inventor expressly excludes any interpretation of the claims or the language used in this specification such as may be made in the USPTO, or in any other Patent Office, other than those interpretations for which express support can be demonstrated in this specification or in objective evidence of record in accordance with In re Lee, (for example, earlier publications by persons not employed by the USPTO or any other Patent Office), demonstrating how the terms are used and understood by persons of ordinary skill in the art, or by way of expert evidence of a person or persons of at least 10 years experience in the railroad industry in North America or in other territories or former territories of the British Empire and Commonwealth.

In terms of general orientation and directional nomenclature, for railroad cars described herein the longitudinal direction is defined as being coincident with the rolling direction of the railroad car, or railroad car unit, when located on tangent (that is, straight) track. In the case of a railroad car having a center sill, the longitudinal direction is parallel to the center sill, and parallel to the top chords. Unless otherwise noted, vertical, or upward and downward, are terms that use top of rail, TOR, as a datum. In the context of the car as a whole, the term lateral, or laterally outboard, or transverse, or transversely outboard refer to a distance or orientation relative to the longitudinal centerline of the railroad car, or car unit, or of the centerline of a center plate at a truck center. The term "longitudinally inboard", or "longitudinally outboard" is a distance taken relative to a mid-span lateral section of the car, or car unit. Pitching motion is angular motion of a railcar unit about a horizontal axis perpendicular to the longitudinal direction. Yawing is angular motion about a vertical axis. Roll is angular motion about the longitudinal axis. Given that the railroad car described herein may tend to have both longitudinal and transverse axes of symmetry, except as otherwise noted a description of one half of the car may generally also be intended to describe the other half as well, allowing for differences between right hand and left hand parts. In this description, the abbreviation kpsi stands for thousand of pounds per square inch. To the extent that this specification or the accompanying illustrations may refer to standards of the Association of American Railroads (AAR), such as to AAR plate sizes, those references are to be understood as at the earliest date of priority to which this application is entitled.

As a further matter of definition, this specification may refer to structural cross-members. Cross-members most typically are either cross-bearers or cross-ties, particularly when used as underfloor supports. The cars may also include braces, often diagonal braces, in the nature of struts. A cross-bearer is a beam that carries loads applied cross-wise to the long axis of the member, and that has significant resistance to transverse bending. Although full width cross-bearers are used in cars that lack center sills, most commonly a cross-bearer has a moment connection at the center sill, and is mounted to accept vertical loads from the side beams of the car. The arms of a cross-bearer that extend away from the center sill may often be analyzed as cantilevers. A cross-bearer is usually considered to form part of the primary structure of the underframe of the railcar. A cross-tie is a beam, usually of smaller section than a cross-bearer, that typically does not have, or is not relied upon to have, a moment connection at the center sill such as to permit a moment couple to be transferred. A cross-tie is often relied upon to carry transverse loads, and has a second moment of area suitable for resisting bending. Most often the ends of a cross-tie (which "tie" the side sill to the center sill), are analyzed as being pinned connections that are not relied upon to transmit bending moments, but rather that carry vertical loads to simply supported ends. Cross-ties may often be used in intermediate floor spans between adjacent cross-bearers. A cross-tie may be considered secondary structure of the underframe, by comparison to cross-bearers and the main bolster. Cross-ties and cross-bearers both tend to run cross-wise i.e., cross-wise relative to the center sill, or longitudinal direction, of the car. A strut is a member that does not carry transverse loads, but rather is relied upon to carry uniaxial loads along its length in either tension or compression. A strut is not relied upon to have, and is usually not intended to have, a moment-couple connection, but is generally intended to have, and to be analyzed as having, a pin-jointed end the does not transmit a moment.

FIG. 1*a* shows an isometric view of an example of a railroad freight car 20 that is intended to be representative of a wide range of railroad cars in which the present invention may be incorporated. While car 20 may be suitable for a variety of general purpose uses, it may be taken as being symbolic of, and in some ways a generic example of a freight car having a straight through center sill. It may be a gondola car, in which lading is introduced by gravity flow from above. The gondola car may be a rotary dump gondola, and, in particular, may be a bathtub, or quasi-bathtub, gondola car as illustrated. Other than ancillary fittings, the structure of car 20 may tend to be symmetrical about its longitudinal centerline axis. Notably, as described below, the B end of the car is somewhat different from the A end of the car due to the asymmetric brake valve and reservoir installation. Otherwise, the car is also symmetrical about its transverse mid-span center line plane By way of a general overview, car 20 may have a car body 22 that is carried on trucks 24 for rolling operation along railroad tracks. Car body 22 may typically be of all welded steel construction, or may be of mixed mild steel, aluminum, stainless steel or composite construction or any suitable combination thereof. Car 20 may be a single unit car, or it may be a multi-unit car having two or more car body units, where the multiple car body units may be connected at an articulated connector, or by draw bars. In gondola cars the density of lading may typically require that multi-unit cars be connected by draw bars rather than articulated connectors. Car body 22 may have a lading containment vessel, receptacle, accommodation or structure, or shell 26. Shell 26 may include a generally upstanding wall structure 28 which may include a pair of opposed first and second end walls 30, 32, that extend cross-wise, and a pair of first and second deep side beam assemblies, that may be identified as sidewalls 34, 36 that extend lengthwise. The end walls 30, 32 and side walls 34, 36 co-operate to define a generally rectangular form of peripheral wall structure 28, when seen from above. In some embodiments the structure may be overlain by a cover 38, such as may tend to permit the lading to be less exposed to wind, rain, snow, and so on, and, to the extent that the lading may be malodorous, perhaps also to contain the smell of the lading in some measure.

Wall structure 28 may include top chords 40, 42 running along the top of sidewalls 34, 36, and side sills 44, 46 running fore-and-aft along lower portions of side walls 34, 36. The side sills 44, 46 may have the form or a closed hollow section, as indicated, this hollow section defining a torque tube that runs along the foot of the sidewalls of the car. Side walls 34, 36 may act as deep beams, and may carry vertical loads to the main bolsters 80 that extend laterally from the center plates 50, which seat in the center plate bowls of trucks 24. Side sills 44, 46 also act as a bottom flange of the beam in opposition to the top flanges of the beams defined by top chords 40, 42. In one embodiment, as shown, the torque tube may be a rectangular steel tube having upper and lower flanges, and inner and outer webs. Sidewalls 34, 36 may also have vertical posts, or strakes, or stiffeners or reinforcements 52, 54, spaced therealong. Posts 52 may be wider, or may have a greater weight of section, than posts 54. Those posts may be aligned with cross-bearers and cross-ties, respectively. These reinforcements, or posts, may have hollow sections and may be in the form of three sided channels of constant section as shown in FIG. 1*a*, or of tapering section as shown in the alternate embodiment of FIG. 1*g*, with the toes welded inward against the web defined by the side sheet 60 of walls 34, 36, or the posts may be of three-sided section with the toes welded to the side sheet to form a hollow box, with the base of the back or flange of the post adjoining the side sill being wider than the distal tip that adjoins the top chord. In each case, the depth of the resultant hollow section may be substantially the same as the width of the torque tube, i.e., the hollow structural section of the side sill, 44, 46.

Car 20 includes a straight-through center sill 62, running from one end of the car body to the other. In the case of a single, stand alone car unit, draft gear and releasable couplers may be mounted at either end of the center sill. To the extent that the car is to be emptied in a rotary dumping apparatus, couplers 64 may be rotary couplers that allow the car to spin about a longitudinal axis running through the coupler centerlines.

The containment structure may include a bottom, floor or deck, indicated generally as 70. This floor or deck serves to discourage downward escape of the lading. It may include end portions 72 and a central or intermediate portion 74. End portions 72 may include a substantially planar shear plate 76 that runs between the bottom chords of the side sills, typically at the level of the top flange of the center sill and the top flanges of the arms 78 of the main bolster 80. The shear plate 76 extends over truck 24. The central or intermediate portion 74 lies between, and clear of, trucks 24 and may include first and second tub arrays 56, 58 that extend downwardly of the level of the center sill top flange and of the side sills. Intermediate portion 74 extends over the major portion of the length of the car between the first cross-bearers immediately longitudinally inboard of the truck centers. Cross-bearers 82 may extend laterally from the center sill at spaced locations along the central portion of the center sill, and may connect the center sill and the side sills. Sidewall posts 52 may be mounted to sidesheets 60 in line with, and connected to the outboard ends of, cross-bearers 82, and at the ends of the main bolster 80. The smaller, intermediate posts 54 may be mounted in the half way spaces between the tapered posts. The car body may also include internal stiffening posts 84, described in greater detail below.

At the 'B', or brake installation, end of the car, the deck may also include a raised end or "mezzanine" portion, or step deck 86 that lies longitudinally outboard of main bolster 80 and runs to the end wall of the car. The brake reservoir 88 and various brake fittings are mounted at the 'B' end of the car beneath this raised deck portion. There is a stub wall 90 that extends in a vertical plane above the outboard web 92 of main bolster 80. A vertical main post 94 of a hollow section forming a rectangular tube rooted to the center sill runs up the end wall of the car. This mezzanine floor, or dog house feature to accommodate the brake valve and brake reservoir is an asymmetric feature, i.e., there is no corresponding feature at the 'A' end of the car. This results in a net volumetric gain at the 'A' end that may be of the order of 200 cu. ft., at a location well below the center of gravity and well below the 98 inches above TOR limit.

Straight-through center sill 62 may have vertical webs 96, 98, a top cover plate, or upper flange 100, and a bottom cover plate or bottom flange 102. The webs may be spaced to leave an inside width (e.g., 12⅞") to accommodate standard draft fittings and couplers. Top cover plate 100 may extend only over the length wise spanning distance of the tubs between end shear plates 76, which then form the top flanges of center sill 62 over trucks 24.

Cross bearers 82 also have the form of rectangular box beams, having a top flange 104 flush with top flange 100 of center sill 62, the two meeting at a radiused root portion of the top flange at which a full penetration weld is made; a bottom flange 106 that is flush with bottom flange 102 of center sill 62 and is joined thereto in the same manner as upper flange 104; and a pair of spaced apart side webs 108, 110. The center sill has internal webs 112 welded between webs 96, 98 in line with webs 108, 110 to provide web continuity across the center sill. The ends of cross-bearer arms 114 are capped by end plates 116 that have a broadened and radiused upper margin that is welded along the lower outer edge of the torque tube i.e., side sill 44, in line with the outer, or back, flange of the posts 52, thus providing a single continuous broad load path through which stresses in the post flange 118 may be carried into the end of the bolster. The main bolster is similarly constructed as a box, with the usual geometry for accommodating the side bearings and clearing the wheels.

Figure 2A:
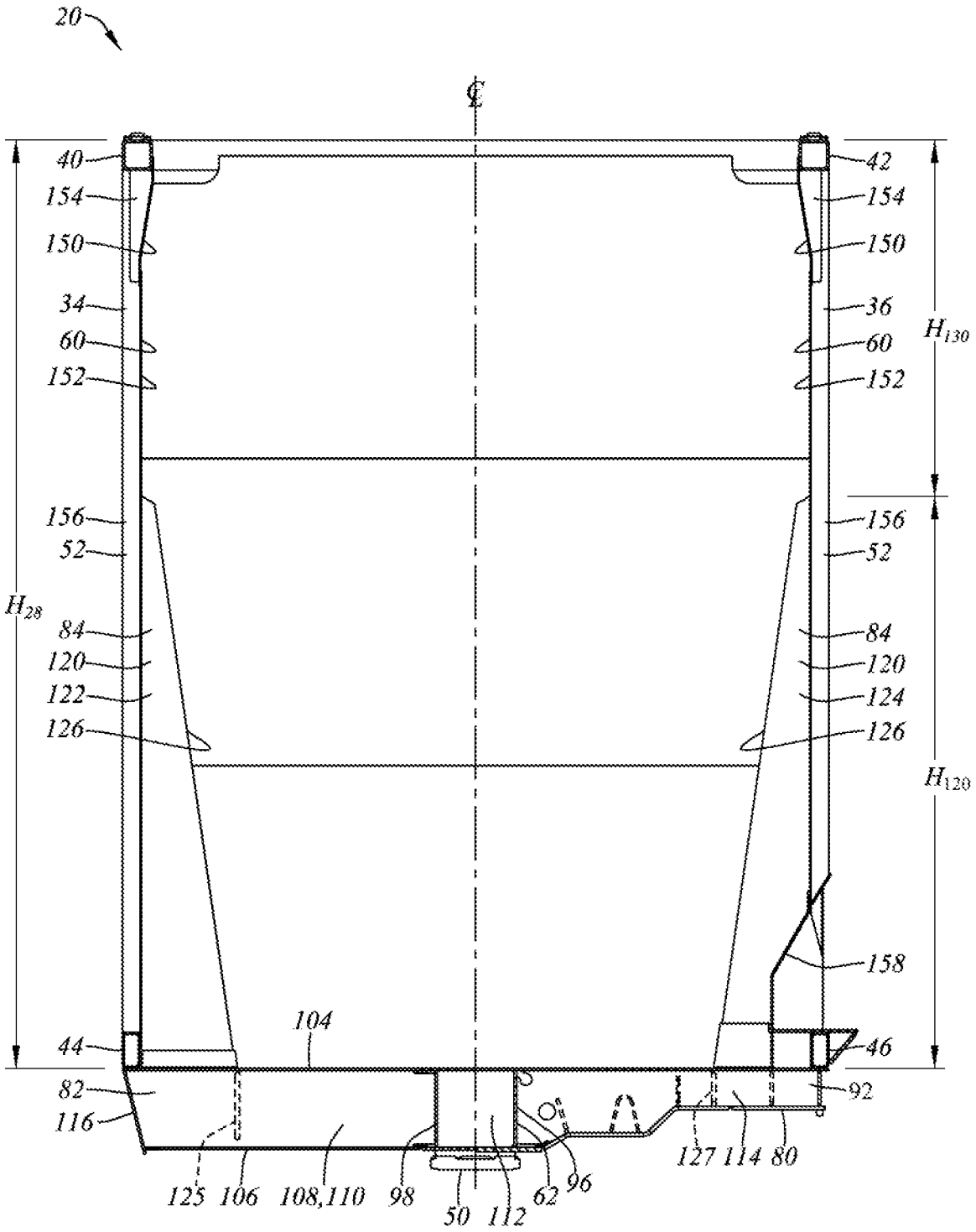
FIG. 2*a* is a transverse sectional view of the railroad freight car of FIG. 1*a* taken on staggered section '2*a*-2*a*' of FIG. 1*e* looking longitudinally inboard.
Figure 2B:
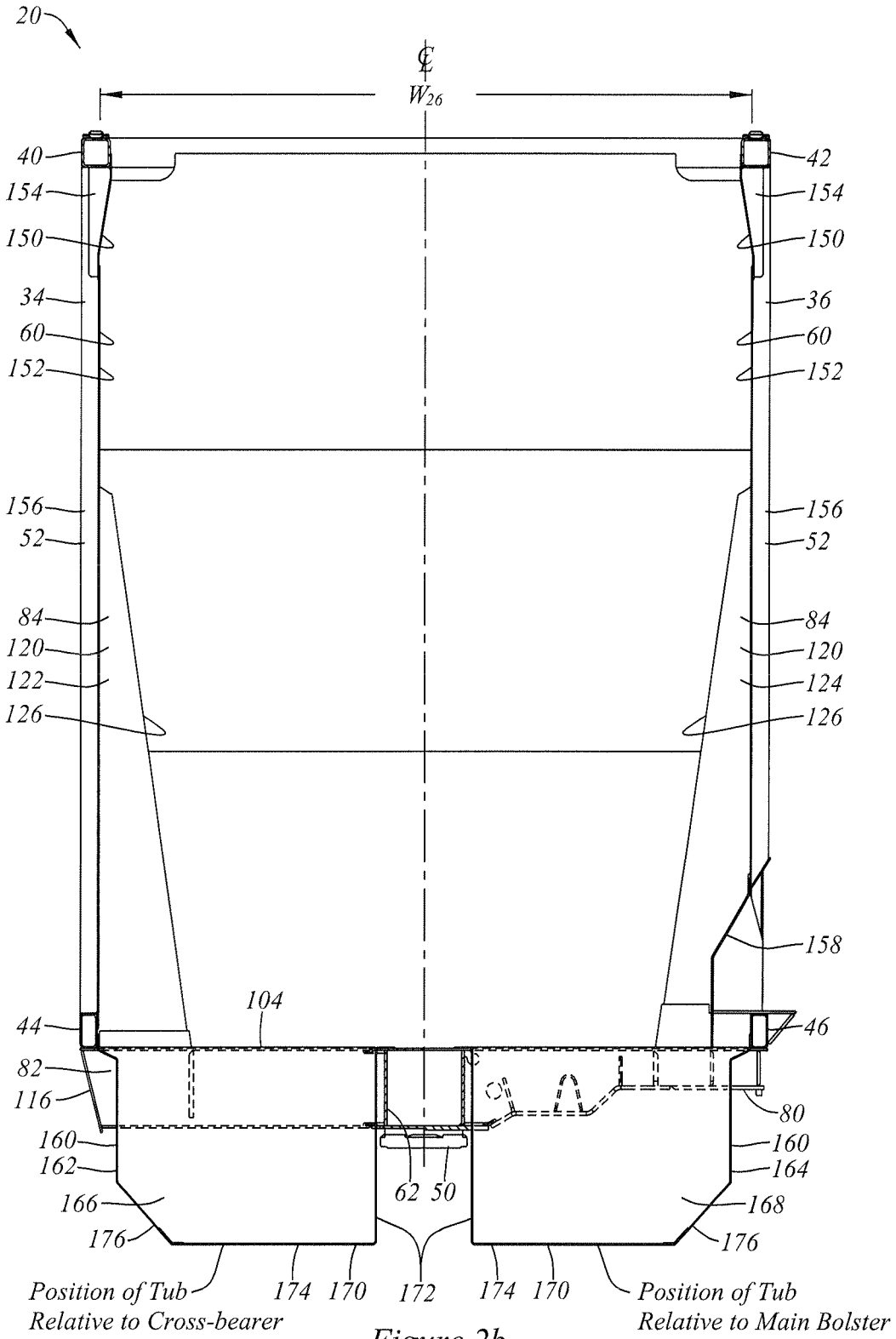
FIG. 2*b* is a transverse sectional view of the railroad freight car of FIG. 1*e* taken on section '2*b*-2*b*' of FIG. 1*e* showing the relative relationship of the downwardly extending tubs to the bolster and cross bearers.
Figure 2C:
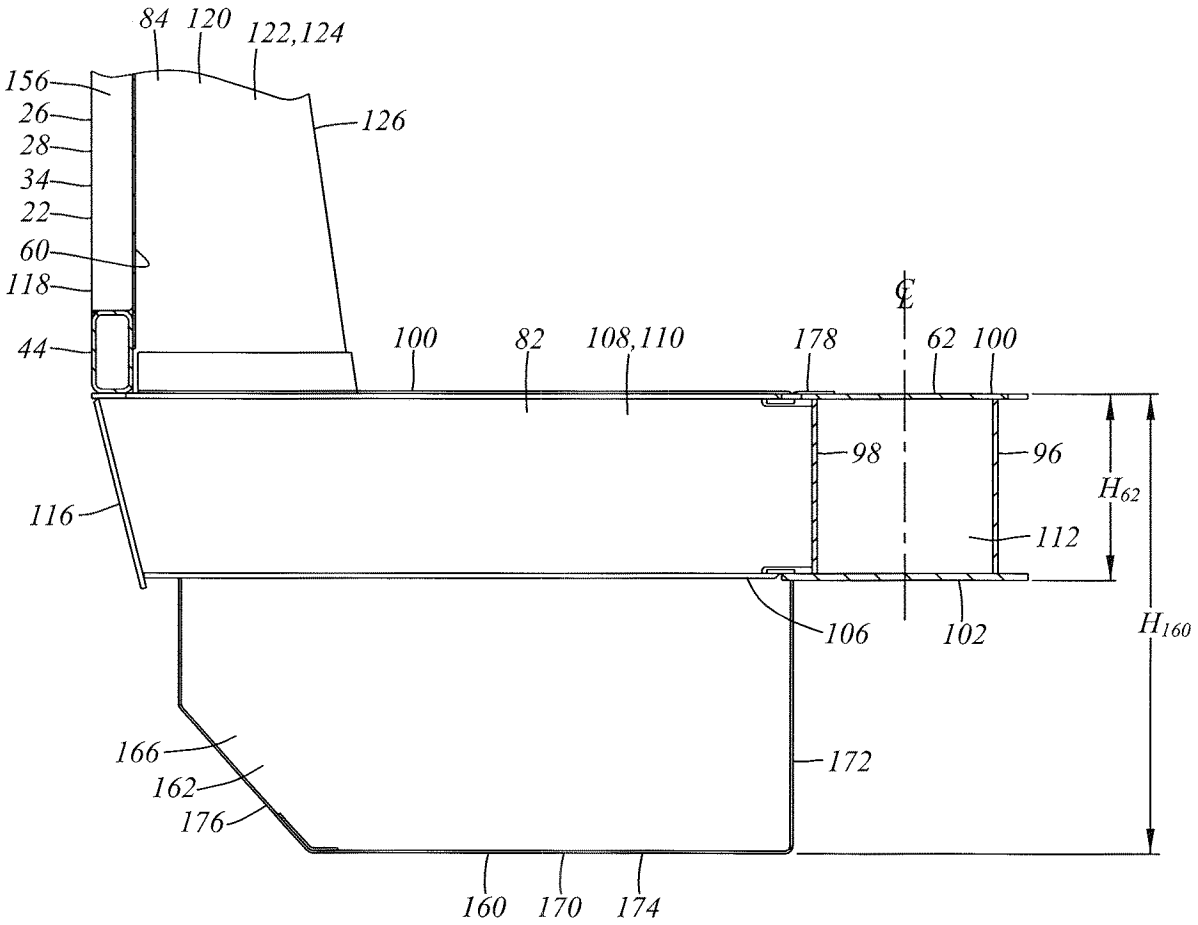
FIG. 2*c* is an enlarged detail of the railroad freight car of FIG. 2*a;*
Figure 2D:
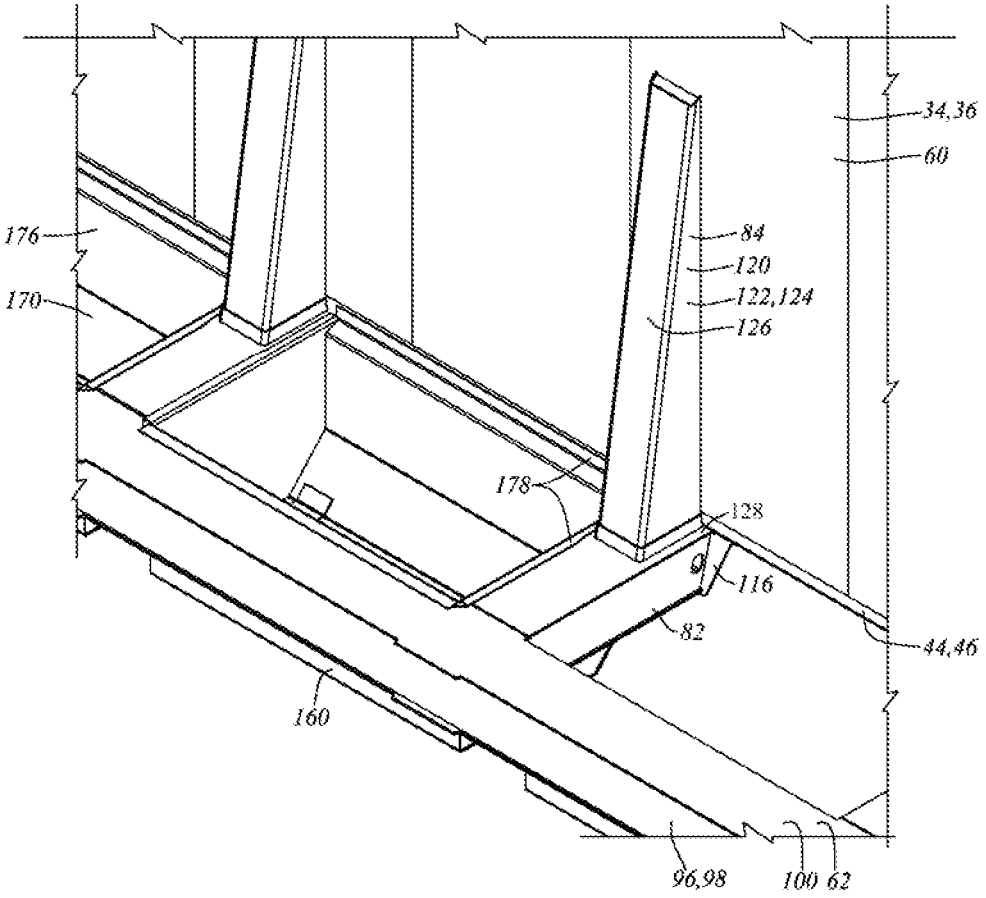
FIG. 2*d* is an isometric view of the detail of FIG. 2*c*.

Wall reinforcements 120 in the nature of internal stiffening posts 84 are mounted to alternate pairs of cross-bearers 82, and serve to discourage the side walls from bulging outwardly under load. As indicated, posts 84 are mounted at the longitudinal stations of the central cross-bearers, as at 83, the second pair of longitudinally outboard cross-bearers as at 85, and at the main bolsters, as at 87. Stiffening posts 84 include generally triangular side sheets 122, 124, and an inclined flange 126. The triangular side sheets 122, 124 are welded to the top cover, or top flange, 104 of the respective cross-bearers 82 with slightly narrower separation than webs 108, 110 of cross-bearers 82 themselves, leaving an exposed shoulder 128, as indicated in FIG. 2*d*. A gusset 125 is mounted inside the respective cross-bearer 82 (or gusset 127 inside the arm of the main bolster) to provide flange continuity above and below the top cover. It may be noted that at these locations the depth of the reinforcement is the combined depth of the internal reinforcement and the external tapered post that is aligned with the reinforcement at that cross-bearer. In these locations, the side sheet of the side wall actually lies in an intermediate location between the outer fiber (the back of the external post) and the innermost fiber (the flange of the internal stiffener). In effect, this junction forms a large structural knee. For the purpose of this specification, a structural knee is formed where a pair of flanges (which may include web or flange continuity gussets) of a first beam and a pair of flanges from a second beam form a quadrilateral connected to four edges of a mutually shared shear plate (or shear plates). Typically, the flange pairs intersect, and the shear plate lies in a plane that is mutually perpendicular to both pairs of flanges. In the instant example, the flanges of the cross-bearer carry a moment couple that opposes the moment couple carried by flange 126 and the flange of post 39 as carried through the sidewall of the side sill and end plate, i.e., stub wall 90. The webs of the cross-bearer form the resolving planes, or members, where these moment couples meet and are balanced. The resultant structure is, in essence, a very large U-shaped spring made up of one of the cross-bearers as the back and two of the tapered side-posts in combination with two of the tapered internal supports as the legs. The legs of the spring then extend upward to the top chord, and may tend to resist lateral deflection of the top chords, whether inward under longitudinal squeeze loads when empty, or outwards under the pressure of the lading.

At these locations the through-thickness depth of the reinforcement is the combined depth of the internal reinforcement and the external tapered post that is aligned with the reinforcement at that cross-bearer. In these locations, the side sheet of the side wall actually lies in an intermediate location between the outer fiber (the back of the external post) and the innermost fiber (the flange of the internal stiffener). The inset of the side sheet is the same as the depth of the legs of the outside reinforcement. That depth may be in the range of 2"-6", and, in one embodiment may be about 3". The side sheet extends in a plane parallel to the plane of the back flange of the sidewall stiffener.

Figure 1F:
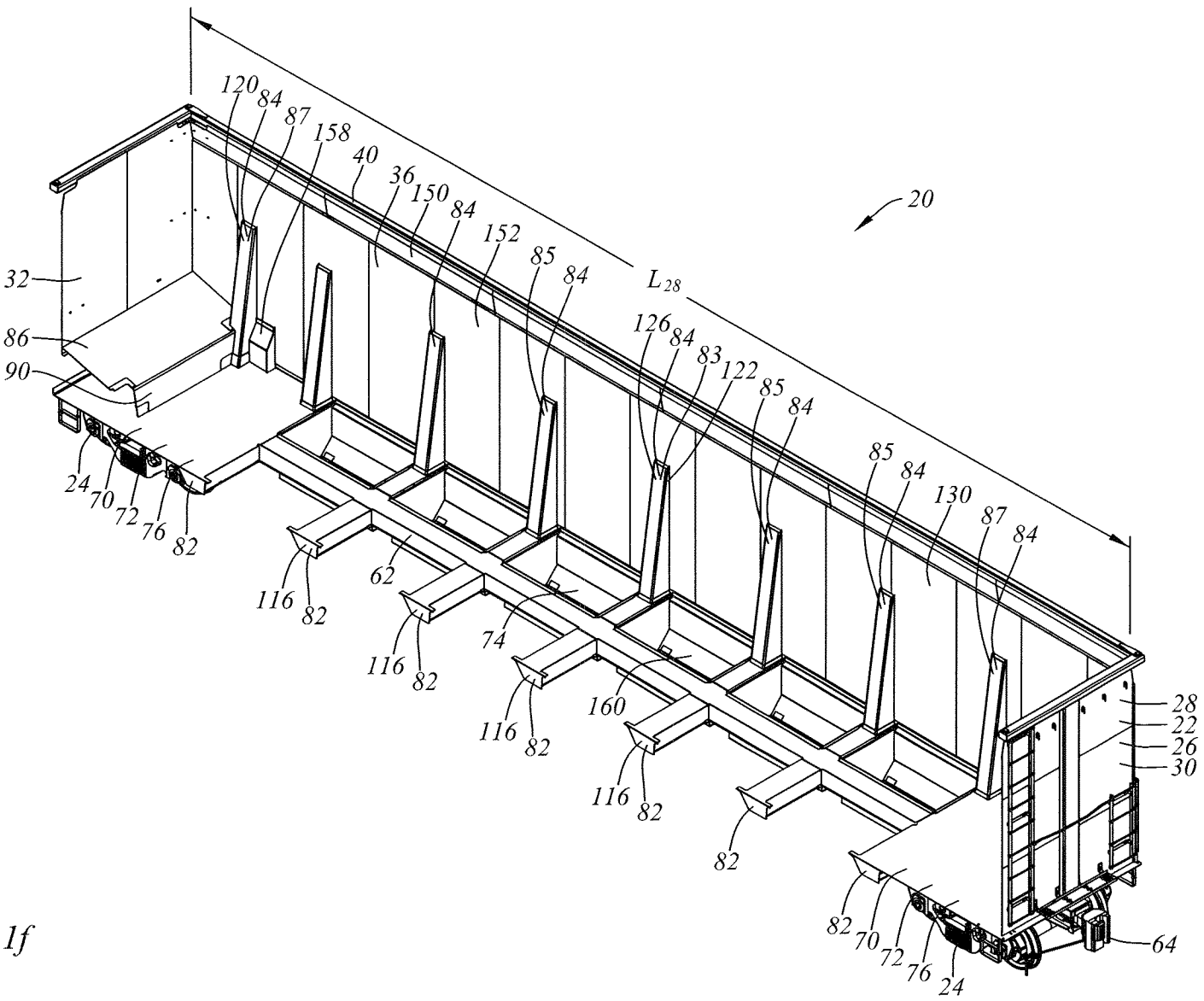
FIG. 1*f* is a partial cut-away isometric view of the railroad freight car of FIG. 1*a* showing details of construction of the car.
Figure 1G:
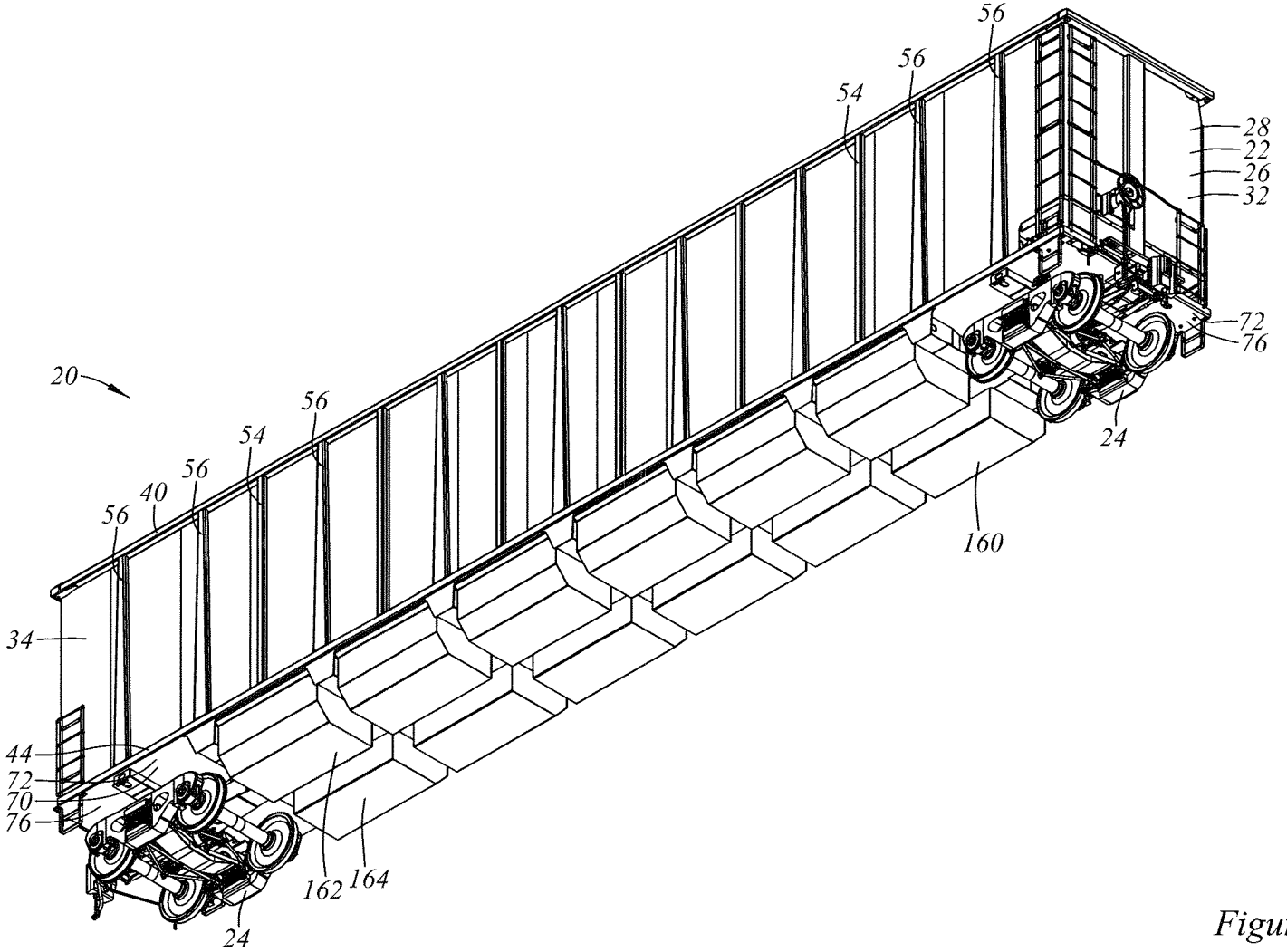
FIG. 1*g* shows an alternate embodiment of gondola car to that of FIG. 1*a;*

In one embodiment, as shown in FIGS. 1*f* and 2*d*, internal reinforcements 120 do not extend to the full height of the car. Rather they terminate at a height well short of the top chord, and there is a region of the side wall, indicated as upper region 130, that is free of internal obstructions or protrusions such as posts 84, and, above this height the walls a reinforced only externally, as by the upper or distal end regions of posts 52 and 54. The vertical extent of this region is indicated as $H_{130}$. This may permit a compaction device, or press, or hammer, to work on the lading as it is loaded from above, while tending to avoid damage to the internal posts (because of the clearance height) and to the external posts (because they are outside the side wall sheet). In one embodiment, $H_{130}$ may be of the order of 4-8 feet, and may be about 6 ft. Expressed differently, $H_{130}$ may be in the range of ⅕ to ⅗ of the overall height of side wall 34 (or 36) from side sill 44 (or 46) to top chord 40 (or 42), and in one embodiment may be in the range of about ¼ to ½ of that height, and in another embodiment may be in the range of about ⅓ to ⅜ of that height.

Figure 2E:
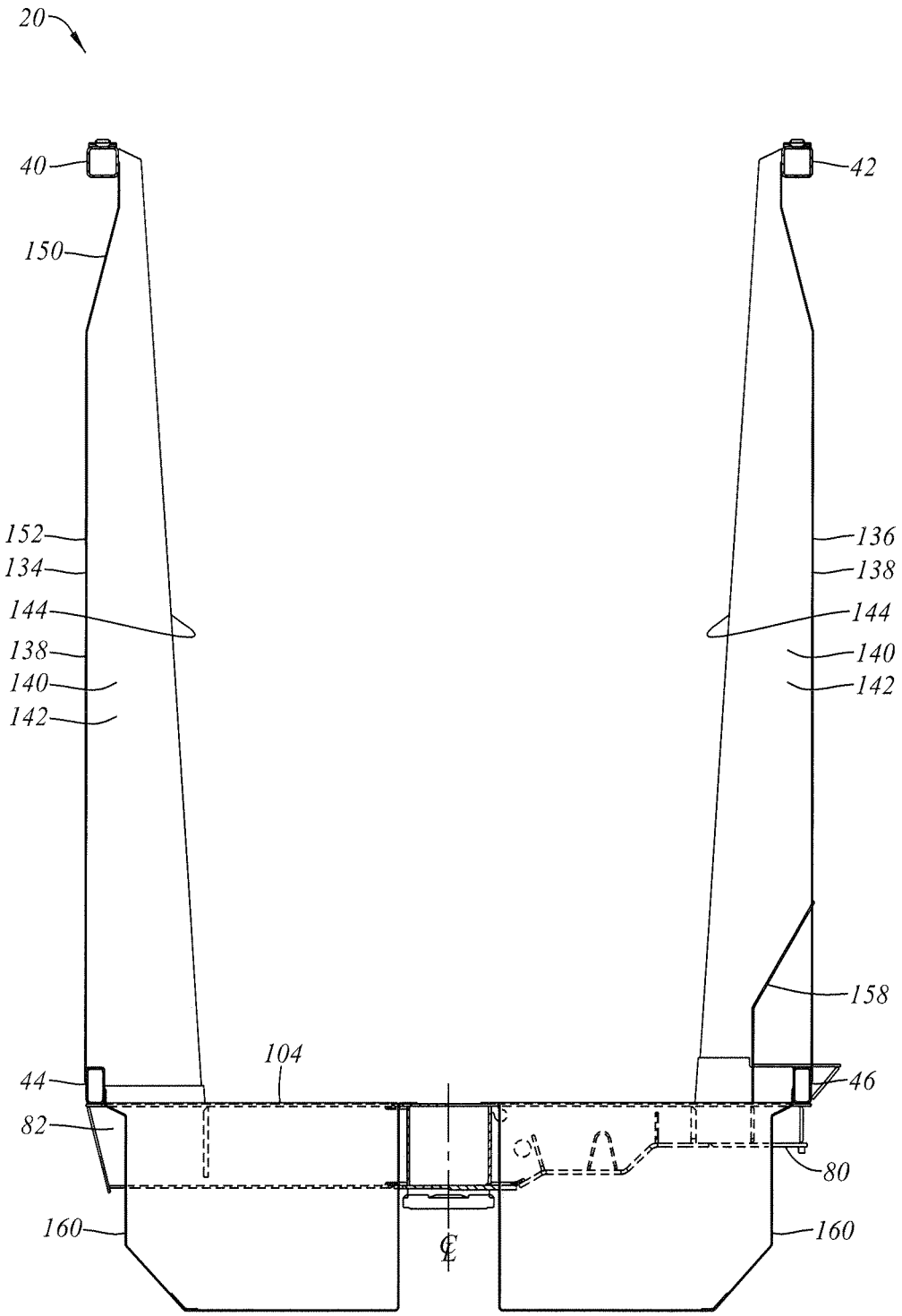
FIG. 2*e* shows an alternate embodiment of gondola car to that of FIG. 2*b;*

In another embodiment, as shown in FIG. 2*e*, where, perhaps, the internal stiffeners may not be as exposed to possible damage from loading and unloading equipment in quite the same way, the car has sidewalls 134,136 having sidewall sheets 138 and internal stiffeners 140. In this instance, sidewall stiffeners 140 have a base or root, or proximal end at deck 70, and a tip or distal end at, or adjoining, or connected to top chord 40 or 42. Stiffeners 140 may be understood to have the same structural knee connection to the cross-bearers or main bolster as described above. Stiffeners 140 may be substantially triangular when viewed in profile, having a pair of spaced apart triangular side webs 142 having a wide base at deck 70 and the narrow tip at top chord 40 (or 42), and an inner back or flange 144. Webs 142 may be planar and parallel, or may taper from a wide spacing at deck 70 to a narrower spacing at top chord 40 (or 42). Flange 144 may correspondingly be of constant width or of tapering width. The vertical outboard edges of webs 142 may abut side sheet 138, which, in this instance, is located at the external extremity of the car body. i.e., this embodiment is free of, or substantially free of, vertical reinforcing posts located outboard of the sidesheets. As such it may gain volumetric capacity by the increase in width between the sidesheets of the opposites sidewalls of the car.

In either case, the upper region of the sidewalls includes a dog-leg, or kink, or sweep, or angled skirt portion, indicated as 150 that joins the main, substantially planar portion 152 of side sheet 60 (or 138, as may be) along its upper vertex, and then runs upwardly and inwardly on a slope to mate with the inboard edge of top chord 40 (or 42). In the case of the embodiment of FIG. 1*a*, closure members, or webs, or gussets 154, of generally triangular shape, are mounted between the sides 156 of the reinforcement posts 52, 54 and portion 150. Portion 150 may itself have a bent lower edge such that a lap joint may be formed with the upper margin of the main portion of sidewall sheet 60 (or 138).

In the embodiment of FIG. 1*a*, top chord 40 (or 42) has a section that has greater depth in the lateral direction than the depth of the external sidewall support posts 52, 54. In some embodiments, this lateral depth of section may be greater than the through thickness of the torque tube i.e., side sill 44. For example, the top chord may have a section of 5×5 inches, whereas the torque tube may be 3×6 inches. The top chord has a greater enclosed cross-sectional area, a greater second moment of area in the lateral direction, and a greater weight of section per unit of lineal measure than the torque tube. Also in the embodiment of FIG. 1*a*, the depth of the side reinforcement may be such as to be equal to, or substantially equal to, the depth accommodation required for safety appliances, such as the ladders mounted at the points (i.e., the corners) of the car, such that those safety appliances may lie predominantly or entirely within the outer width envelope of the car overall as defined by the outer extremity of the backs of the posts. That is, the ladders lie predominantly or completely within the envelope of the side reinforcement posts.

At each end, at the location of the main bolster, there is an accommodation 158, which may be a rotary dumping apparatus engagement member accommodation. This accommodation may permit a claw of a rotary dumping machine to grasp the car body prior to rotation. To the extent that car 20 is a rotary dump gondola, the members of the car defining the lading containment envelope, i.e., the predominantly upstanding sidewall members of the side beams and end walls, and the tubs defining the lading carrying portions of the car that lie downwardly of the level of the top flange of the center sill, may be free of discharge gates such as might be found in a flow through car. The rotary dumping equipment may include clamping elements or claws that tend to draw the car downwards, i.e., to compress the springs of the trucks, to keep the car firmly clamped on the rails. The equipment may also include clamping members that bear against the outsides of the posts. The inward step of the side sheets relative to the exterior post flanges may tend to mean that clamps of the rotary dumping equipment may bear against the relatively laterally stiff post flanges, rather than against the relatively laterally less robust side sheets.

Tubs 160 of tub left and right tub arrays 162, 164 may be prefabricated liners, or buckets, or baskets, or troughs, or simply tubs (however they may be termed) that have a uniform size corresponding to the generally rectangular envelope defined between adjacent pairs of cross-bearers 82, center sill 62, and side sill 44 or 46. Each tub 160 has a pair of end walls 166, 168, and a base wall 170 that may be bent to yield an inside wall 172, a bottom wall, 174, and a dog-legged outer wall 176. The general form of base wall 170, as bent, conforms to the profile of end walls 166, 168. Each of walls 166, 168 and 170 has a bent lip, such as indicated at 178, that, on installation, overlaps the adjacent cross-bearer top cover plate or center sill top cover plate, as may be, and is welded thereto accordingly. The upper margin of outer wall 176 overlaps and is welded to the inside web of side sill 44 or 46 as may be. The tub materials are generally thinner than the flange materials of the cross-bearers and center sill. In the event that the tubs are damaged or wear out, to the extent that they do not form any portion of the primary structure of the railroad car underframe (i.e., the center sill, cross-bearers and main bolster, the side sills), they can be replaced as modular single units without having to cut, remove or otherwise damage the underlying primary structure.

It may be noted that the underside of the car resembles an ice-cube tray to some extent. As such, the term "ice-cube tray gondola car" used herein means a bathtub gondola car in which the "bathtub" is subdivided into smaller tubs by the center sill and the cross-bearers, such that the resulting gondola car has an array of tubs that resembles an ice-cube tray. In one embodiment of such a car, as illustrated, there are several cross-members, be they cross-bearers or cross-ties or such like that perform a structurally equivalent function, spaced longitudinally along the middle portion of the car between the trucks, and a series of lading containing members, such as might be termed buckets, or tubs, mounted to sit between the cross-members. The bottom portion of the car may thereby tend to have the appearance, at least in part, of an ice-cube tray. In some embodiments the cross-members may tend to lie flush, or roughly flush, with the top cover plate of the center sill. In some embodiments the tubs may tend to extend downwardly beyond the cross-members. Aside from the modularity of the tubs, the use of both (a) cross-bearers capable of carrying a bending moment, and (b) a series of tubs, may tend to yield a car with increased lading capacity (as compared to a traditional gondola with a floor flush with the top cover of the center sill); a reduced center of gravity height as compared to a car with a floor flush with the top cover of the center sill (due to lading being carried lower on the car than otherwise); and intermediate bending-moment-carrying structural members such as may resist lateral deflection of the sidewalls. In some embodiments this may be done without providing strut work inside the body of the car such as might otherwise perhaps be more vulnerable to, or more prominently exposed to, abusive loading (or unloading) practices, or upon which refuse or other objects loaded into the car might otherwise be prone to catch or snag during removal. That is, a railcar used for carrying municipal waste may not necessarily always be loaded with the utmost care and precision. Such cars may be subject to abuse, and it may be helpful for the structure of the car to be both (a) relatively robust; and (b) less exposed. The cross-members described lie under the floor sheets of the car, such that, in expected use, lading should not be able to be caught under or behind the cross-members as it may do with more exposed struts and ties as sometimes seen in coal or other gondola cars. When the car is emptied in a rotary dumper, the lading should fall out without becoming hung up on internal struts. In some embodiments, such as that shown, the car may be entirely free of such struts. Alternatively, to the extent that such struts may still be desired or required, nonetheless, the presence of the moment-coupled spring-like structures may tend to reduce the number of such strut members employed.

The structure described above may be used in the context of a gondola car having an high aspect ratio. That is, the car has, at least in the context of gondola cars, an abnormally large ratio of wall height to car width. The wall height, $H_{28}$, measured from the bottom of the side sills to the top of the top chord, is greater than the car width between the side sheets, indicated as $W_{26}$. In one embodiment, the ratio of height to width is greater than 5:4. In another is in the range of about 11:8 to about 3:2 (+/−). In one embodiment the height is 155" and the width is 108". The height of the braces, namely of wall reinforcements 120, indicated as $H_{120}$, is greater than ⅓ of the car width $W_{26}$. It may be greater than ⅗ of the car width, and, in one embodiment, as illustrated, it may be greater than half the car width, and may be in a ratio of roughly 5:3 to 2:1 relative to the car half width. In one embodiment it may be about 85" to 100". Expressed differently, the reinforcements may have a base width $W_{26}$, that is more than ⅛ of the wall height, $H_{28}$. In one embodiment the ratio of $W_{26}$:$H_{28}$ may lie in the range of ⅙ to ⅓, and in one embodiment may be about ⅕. Expressed differently yet again, the ratio of the height $H_{120}$ to height $H_{28}$ may be greater than 1:4, and may lie in the range of 3:10 to 7:10, and, in one embodiment, may be about ⅝ to ⅔ (+/−). In one embodiment, the truck centers are between 58 and 60 ft apart, $H_{28}$ is roughly 13 ft. In another embodiment, the inside length of the car is greater than 80'-0" and may be over 85'-0" with a length over the strikers of more than 89'-0" such that internal volume is greater than 10,000 $ft^3$. The overall height of the car, including a 6" (+/−) deep cover, from top of rail may conform to AAR Plate F (i.e., 204"). The inside width $W_{26}$ is 9 ft, and the inside length is just over 67 ft. The height of the center sill top cover is about 43" above TOR, and the clearance of the tubs is 9'-10" from TOR. The depth of the center sill $H_{62}$ is about 14" and the overall depth of the tubs is about 34". The tubs extend downwardly about 20 inches beyond the bottom of the cross-bearers, (and, to the extent the cross-bearer and center sill bottom flanges are flush, also beyond the center sill bottom flange). The tubs 160 not only extend downwardly beyond the center sill and cross-bearers, but are therefore roughly 2-2½ times as deep as the cross-member and center sill. The cross-bearers are about 12" wide, and are spaced on roughly 92"-93" centers, with 80" long×50" wide tubs 160 seated between the adjacent cross-bearers. The internal volume of the car may be greater than 7500 cu. ft., and, in one embodiment, may be roughly 8700 cu. ft. By most standards, this would be considered a high volumetric capacity gondola car. The volume of the ice-cube trays (i.e., the volume of the arrays of tubs 162, 164 shy of the level of the center sill top cover plate 100, may be over 500 cu. ft., may be over 750 cu. ft, and may be roughly 900 cu. ft. for the array of 12 trays shown. Expressed differently, the depressed portion of the lading carrying volume may be more than 5% of the volume of the car, may be more than ⅒ of the total volume of the car, and, in one embodiment, may account for more than 10% of the volume of the car. The ratio of the depth $H_{160}$ of the tubs 160 below the center sill top cover plate 100 to the height of the sidewalls $H_{28}$ measured upwardly from the top cover plate may be more than 1:10, and may lie in the range of 1:13 to roughly 1:4, and, in one embodiment is about 1:5 (in one embodiment it is, roughly 33":156"). The car may also relatively long as compared to the width of the car, and tall compared to its length. That is, in one embodiment the length of the car, inside the endwalls $L_{28}$, may be more than five times the inside width of the car, and the wall may be taller than the inside width. In another embodiment, the car is between 6 and 8 times as long as it is wide. It may also have a sidewall height that is greater than ⅛ of the inside length, and may be in the range of ⅙ to ¼ of that length.

Car 20 may thus have the combination of (a) side sill torque tubes; (b) sidewall stiffeners that are mounted to the cross-bearers at structural knees; and (c) a lading containment envelope that extends below the level of the top flange of the center sill. The lading containment envelope may be defined, at least in part, by a lower portion of the car between the trucks that defines a bathtub. That lower portion may be either a single tub, or a double tub, and may be an "ice-cube tray" array of tubs. Car 20 may have predominantly upwardly extending sidewall stiffeners having an outboard flange member, a co-operating inboard flange member spaced from the outboard flange member. Over at least a non-trivial proportion of the length of the stiffeners, the sidewall sheet is carried in an intermediate position between the inboard and outboard flange members.

Various embodiments have been described in detail. Since changes in and or additions to the above-described examples may be made without departing from the nature, spirit or scope of the invention, the invention is not to be limited to those details.

I claim:

1. A railroad gondola car, comprising:

a center sill;

cross-bearers extending laterally of said center sill;

a car body carried by said center sill and said cross-bearers;

said car body defining a receptacle in which to carry lading;

said receptacle of said car body including sidewalls;

said sidewalls including side beams running parallel to said center sill, said side beams having a top chord, a side sill, and a side sheet extending between said top chord and said side sill;

said side sill defining a torque tube mounted to resist lateral deflection of said top chord;

sidewall reinforcements extending predominantly upwardly from said side sills; and said sidewall reinforcements being connected to respective ones of said cross-bearers at moment-couple transmitting connections.

2. The railroad gondola car of claim 1 wherein at least a portion of said receptacle includes a lading accommodation region lying lower than said center sill.

3. The railroad gondola car of claim 1 wherein said receptacle includes a plurality of lading accommodation regions to either side of said center sill, said plurality of lading accommodation regions extending downwardly of said cross-bearers and downwardly of said center sill.

4. The railroad gondola car of claim 1 wherein:

said cross-bearers include a first cross-bearer having a pair of spaced apart webs, an upper flange and a lower flange;

said reinforcements include a first reinforcement associated with said first cross-bearer, said first reinforcement being connected to said first cross-bearer distant from said center sill;

said first reinforcement having a pair of webs corresponding to said webs of said first cross-bearer;

said first reinforcement has a first flange spaced from said side sheet;

said first cross-bearer has an end cap mounted across said webs of said first cross-bearer, said end cap mating with said lower flange and said upper flange of said first cross-bearer;

said first flange of said first reinforcement and said side sheet being mounted to transmit a moment couple to said upper and lower flanges of said first cross-bearer through said first structural knee.

5. The railroad gondola car of claim 1 wherein:

said cross-bearers include a first cross-bearer having a pair of spaced apart webs, an upper flange and a lower flange;

said reinforcements include a first reinforcement associated with said first cross-bearer, said first reinforcement being connected to said first cross-bearer distant from said center sill;

said first reinforcement has a pair of webs corresponding to said webs of said first cross-bearer;

said first reinforcement has a first flange spaced laterally outboard from said side sheet;

said first reinforcement has a second flange spaced laterally inboard from said first flange;

said first cross-bearer has an end cap mounted across said webs of said first cross-bearer, said end cap having flange continuity with said first flange of said first reinforcement, said end cap being mounted to transfer loads from said first flange of said first reinforcement into said webs of said first cross-bearer;

said first cross-bearer having a flange continuity member associated with said second flange of said first reinforcement, said flange continuity member being mounted between said upper and lower flanges of said first cross-bearer, said flange continuity member being mounted to transfer loads from said second flange of said first reinforcement to said webs of said first cross-bearer;

said upper and lower flanges of said first cross-bearer being mounted to react loads transferred to said webs of said first cross-bearer from said first and second flanges of said first reinforcement.

6. The railroad gondola car of claim 1 wherein:

said cross-bearers include a first cross-bearer having a pair of spaced apart webs, an upper flange and a lower flange;

said reinforcements include a first reinforcement associated with said first cross-bearer, said first reinforcement being connected to said first cross-bearer distant from said center sill;

said first reinforcement has a pair of webs corresponding to said webs of said first cross-bearer;

said first reinforcement has a first flange spaced laterally outboard from said side sheet;

said first reinforcement has a second flange spaced laterally inboard from said first flange; and said side sheet passes between said first and second flanges.

7. The railroad gondola car of claim 1 wherein:

said top chord has an enclosed cross-sectional area, a weight of section per unit of lineal measure, and a second moment of area in the lateral direction;

said torque tube has an enclosed cross-sectional area, a weight of section per unit of lineal measure, and a second moment of area in the lateral direction; and at least one of (a) said enclosed cross-sectional area of said top chord is greater than said enclosed cross-sectional area of said torque tube;

(b) said weight of section of said top chord is greater than said weight of section of said torque tube; and (c) said second moment of area said top chord is greater than said second moment of area of said torque tube.

8. The railroad gondola car of claim 1 wherein said receptacle has a width, said sidewalls each have a height, and said height is greater than said width.

9. The railroad gondola car of claim 1 wherein said receptacle has an inside length, an inside width, and an inside height measured upwardly of said center sill, wherein said inside length is at least five times as large as said inside width, and said inside height is at least as great as said inside width.

10. The railroad gondola car of claim 1 wherein said gondola car is a bathtub gondola car.

11. The railroad gondola car of claim 1 wherein said gondola car is an ice-cube tray gondola car.

12. The railroad gondola car of claim 11 wherein said receptacle includes an array of downwardly depending lading receptacle accommodations, said array including a left hand row and a right hand row of ones of said accommodations extending along said car, and each of said left hand row and said right hand row including a plurality of said accommodations.

13. The railroad gondola car of claim 11 wherein said receptacle includes an array of downwardly depending lading receptacle accommodations; and said center sill and said cross-bearers define socket spaces therebetween in which receptacles of said array of receptacles are located.

14. The railroad gondola car of claim 11 wherein:

said gondola car has a body that includes said side walls, said side walls having side sheets and side sheet reinforcements;

said side sheet reinforcements include upstanding side sheet support posts spaced therealong; and said side sheets support posts are connected to respective ones of said cross-bearers at moment couple connections.

15. The railroad gondola car of claim 11 wherein:

said side sheets and said side sheet reinforcements include upstanding side sheet support posts spaced therealong;

said side sheets support posts are connected to respective ones od said cross-bearers at moment couple connections;

said receptacle includes an array of downwardly depending lading receptacle accommodations, said array including a left hand row and a right hand row of ones of said accommodations extending along said car, and each of said left hand row and said right hand row including a plurality of said accommodations; and said center sill and said cross-bearers define spaces in which receptacles of said array of receptacles extend downwardly.

16. The railroad gondola car of claim 1 wherein:

said sidewalls each include a predominantly upright side sheet;

said sidewalls having respective predominantly upstanding side sheet reinforcements;

said side sheet reinforcements including a first side sheet reinforcement including an outer flange and an inner flange, and a length;

over a majority of said length of said first side sheet reinforcement said outer flange standing laterally outward of, and spaced from, said side sheet; said reinforcement including a member extending laterally inboard and away from said side sheet;

said inner flange extending along an inboard margin of said member; and said inner flange standing laterally inwardly of said side sheet, a portion of said side sheet runs along said reinforcement between said inner flange and said outer flange, said outer flange being laterally outboard of said portion, and said inner flange being laterally inboard of said portion.

17. The railroad gondola car of claim 16 wherein said railroad car includes rotary dumping fittings by which to grasp said receptacle for inversion.

18. The railroad gondola car of claim 16 wherein:

said center sill is a through-center sill;

said receptacle has an inside width, an inside length, and an inside height measured upwardly of said center sill, said inside height being at least as great as said inside width; and said railroad gondola car has a volumetric capacity greater than 8000 cu. ft.

19. The railroad gondola car of claim 16 wherein:

said first side sheet reinforcement includes an exterior member, said exterior member being a channel having first and second legs and a back, said back defining said outer flange, said first and second legs having toes mounted to said side sheets;

said first side sheet reinforcement includes an interior member, said interior member having webs and said inner flange, said inner flange extending between said webs; and said webs of said interior member having toes mounted to said side sheets substantially opposite said toes of said exterior member.

20. The railroad gondola car of claim 19 wherein said interior member tapers from a wide base adjacent said side sill to a narrower toe distant therefrom.

* * * * *